United States Patent [19]

Huang

[11] Patent Number: 4,964,746

[45] Date of Patent: Oct. 23, 1990

[54] ELASTIC CLIP WITH POSITIONING MEANS FOR POSITIONING OF PERFORATIONS

[76] Inventor: Li-Hsii Huang, No. 3, Lane 194, Chang Shui Rd., Changhua, Taiwan

[21] Appl. No.: 330,311

[22] Filed: Mar. 29, 1989

[51] Int. Cl.[5] ..... B42F 13/00

[52] U.S. Cl. ..... 402/25; 402/68; 402/80 P

[58] Field of Search ..... 402/25, 68, 69, 80 R, 402/80 P

[56] References Cited

U.S. PATENT DOCUMENTS

| | | | |
|---|---|---|---|
| 563,956 | 7/1896 | Grady et al. | 402/68 |
| 665,706 | 1/1901 | Toepeert et al. | 402/69 |
| 794,994 | 7/1905 | Mauer | 402/25 |
| 3,018,780 | 1/1962 | Greenblott et al. | 402/69 |
| 3,659,368 | 5/1972 | Colbert | 402/69 X |
| 3,803,729 | 4/1974 | Acerro | 402/68 |
| 4,790,680 | 12/1988 | Givati et al. | 402/68 |

FOREIGN PATENT DOCUMENTS

| | | | |
|---|---|---|---|
| 2337628 | 8/1977 | France | 402/69 |
| 335777 | 10/1930 | United Kingdom | 402/69 |

*Primary Examiner*—Paul A. Bell

*Attorney, Agent, or Firm*—Bacon & Thomas

[57] ABSTRACT

An elastic clip with positioning means for positioning of perforations, including a bottom block with an U-shaped frame bar movably mounted thereon, which U-shaped frame bar is having two positioning rods for positioning of paper documents through two punched holes made on the paper documents. The bottom block is having a bridge frame integrally extended from the rear portion to project upward and to bend forward by means of a folding line, with the front end of the bridge frame formed into a tongue plate for clamping of paper documents and with an arch frame integrally made thereon at the top to reinforce the clamping effect of the tongue plate.

3 Claims, 4 Drawing Sheets

ELASTIC CLIP WITH POSITIONING MEANS FOR POSITIONING OF PERFORATIONS

BACKGROUND OF THE INVENTION

1. Field of the Invention

The present invention is related to an elastic clip with positioning means for positioning of perforations which is integrally made of resilient plastic material by means of injection molding process and connected with an U-shaped frame bar having two positioning rods for penetrating respectively through the two punched holes made on paper documents so as to allow positioning of paper documents through punched holes.

2. Description of the Prior Art

Paper file is an important tool for paper document arrangement and, is commonly used in the office. Regular paper files, except folders, may either comprise a spring clip for clamping papers or a clip for paper positioning through perforations. However, either type of regular paper files has some drawbacks to be improved.

With respect to punch hole positioning clip, one may have to insert fixing strips (thin metal strip or plastic strip) through the two punched holes of papers page by page; or when to remove paper documents from the clip, the papers may be removed page by page to break away from the constraint of the fixing strips. Actually, the operational procedure is rather complicated and time consuming.

In order to solve said problems, the present invention is thus created to provide a kind of elastic clip, which is integrally made by means of shape forming process, with an U-shaped frame bar movably connected thereto for positioning of perforations.

SUMMARY OF THE INVENTION

The main object of the present invention is to provide an elastic clip with positioning means for positioning of perforations, wherein the clip includes a bottom block having an arch frame connected with a tongue plate integrally made at the front for clamping against the bottom block, and with an U-shaped frame bar movably connected thereto, which U-shaped frame bar comperises two positioning rods spaced away from each other for positioning of two perforations made on paper document, such that the tenons to match with the two slots on said flat clamp for setting therebetween of paper documents through the two perforations of the paper documents made by a paper puncher, such that the elastic clip may be used for clamping paper document or for positioning of paper documents by means of inserting the two positioning rods through the two perforations made on the paper documents.

Another object of the present invention is to provide an elastic clip with positioning means for positioning of perforations, which is integrally made by means of injection molding process for easy connection with an U-shaped frame bar for positioning of paper documents through perforations, so as to simplify manufacturing procedure and to reduce manufacturing cost.

Another object of the present invention is to provide an elastic clip with positioning means for positioning of perforations, wherein an U-shaped spring steel is having two hook-shaped ends and provided to mount on an arch frame to reinforce the clamping effect of a tongue plate, which arch frame is having two elongated notches made at both front and rear ends for respective connection of the two hook-shaped ends of the U-shaped spring steel so as to allow the U-shaped spring steel be firmly mounted thereon to further provide the tongue plate with a reinforced elastic force to clamp against the bottom block.

A yet further object of the present invention is to provide an elastic clip with positioning means for positioning of perforations which may be fixedly attached to an elongated board for conveniently holding of hand to form a simple clip board for clamping papers for making notes.

BRIEF DESCRIPTIONS OF THE DRAWINGS

The foregoing and other objects, features and advantages of the present invention will be best understood from the following description, the appended claims and the accompanying drawings in which:

DETAILED DESCRIPTION

Figure 1:
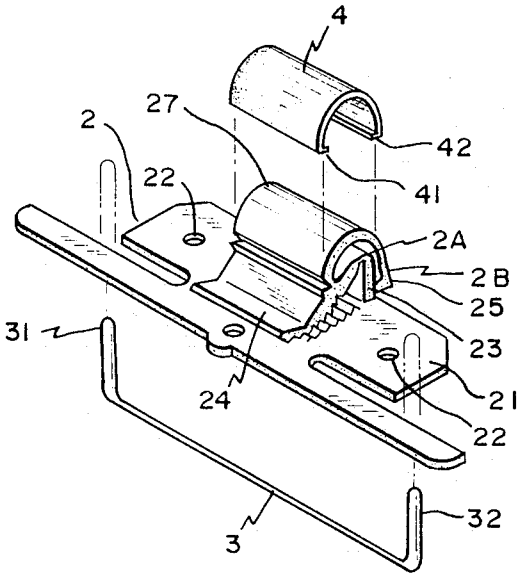
FIG. 1 is a fragmentary perspective view of the present invention (in a clamped position)
Figure 2A:
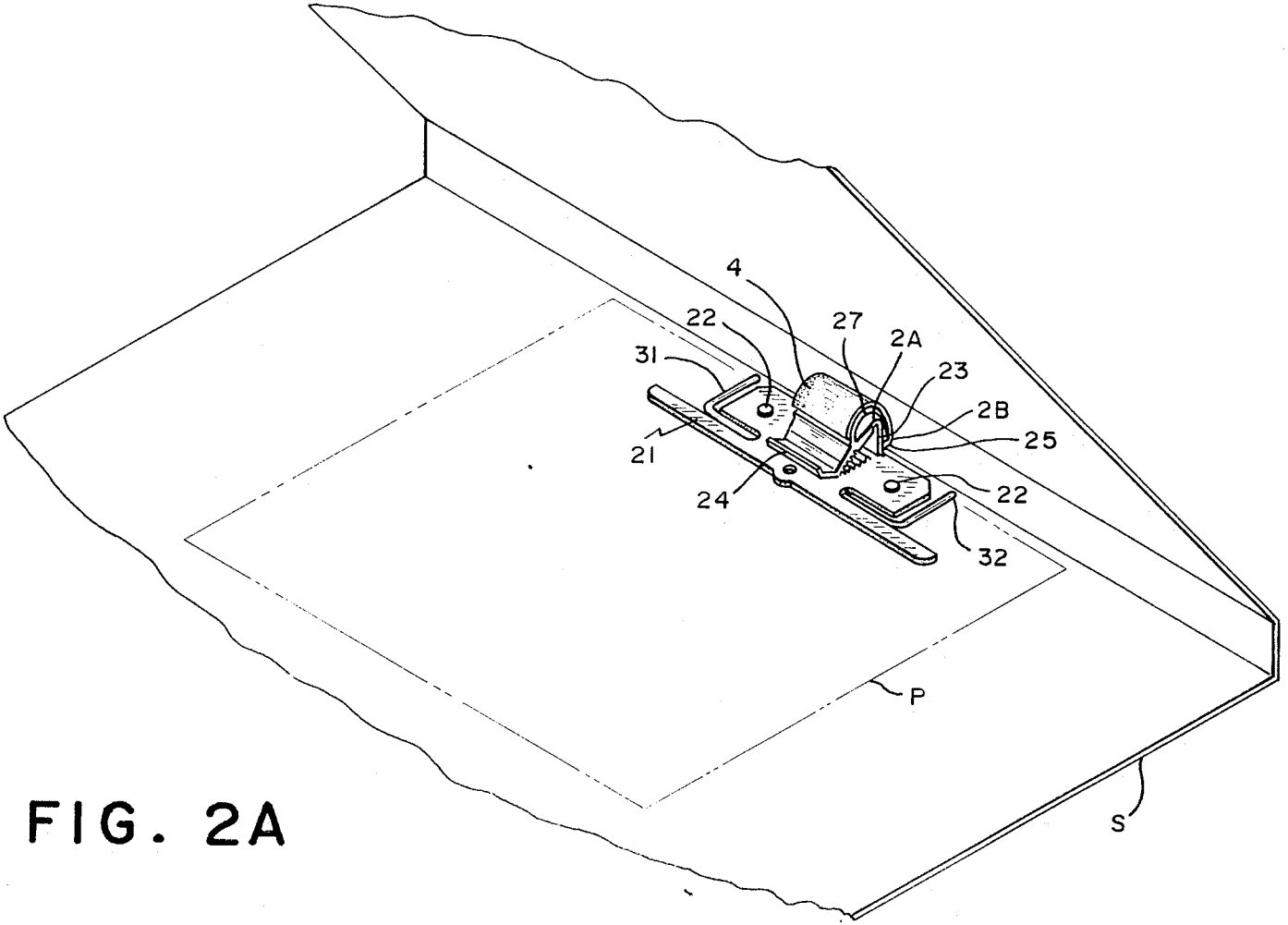
FIG. 2A is a structural perspective view of file made according to the present invention (in a clamped position, clamped with clip)
Figure 2B:
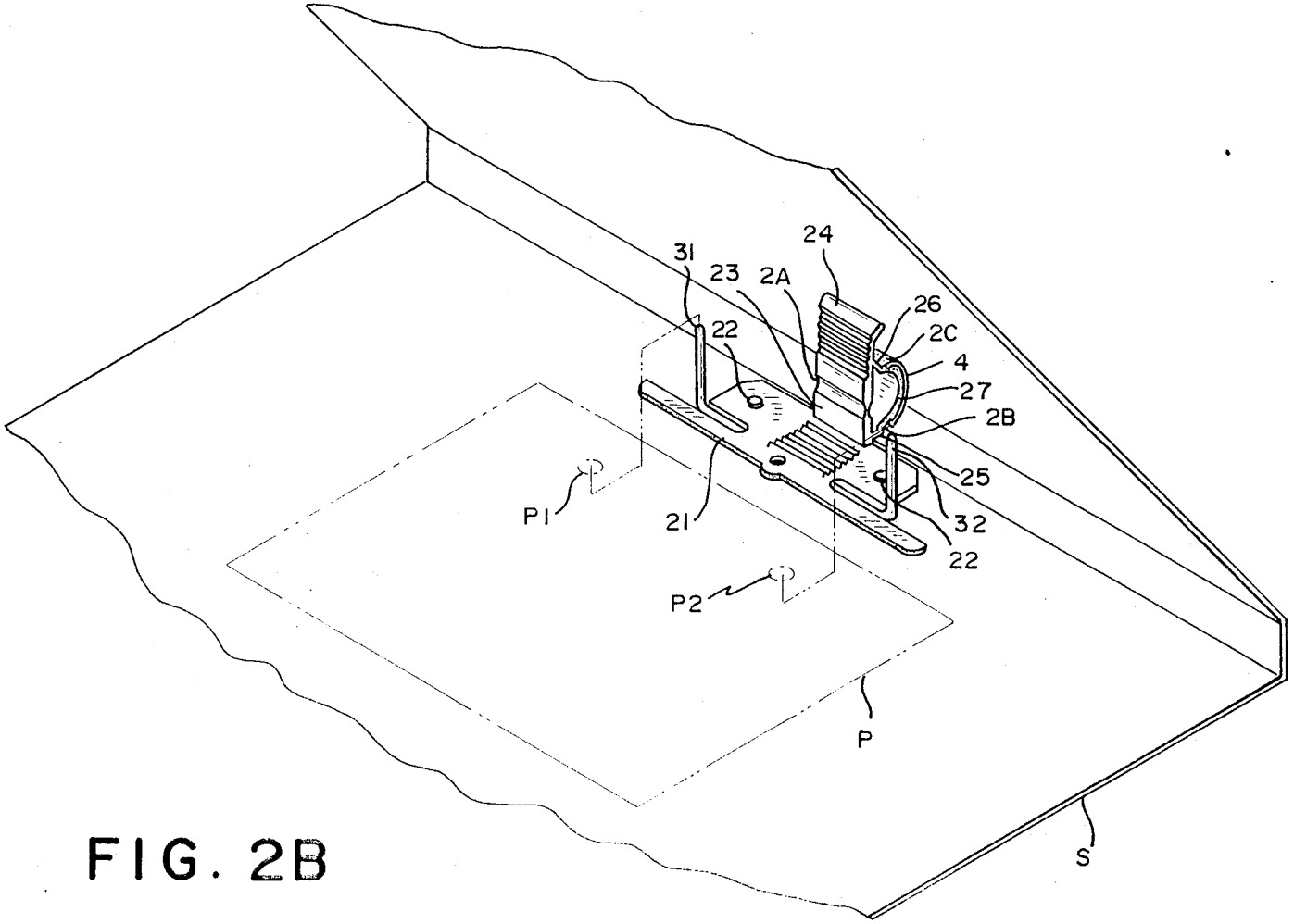
FIG. 2B is a structural perspective view of the said preferred embodiment of FIG. 2A ( in a released position, with paper positioning of perforations means in a ready position)

Referring to FIGS. 1, 2A and 2B, an elastic clip 2 is integrally made by means of shape forming process, comprising a botton block 21 with an U-shaped frame bar 3 movably mounted thereon. The U-shaped frame bar 3 is having two positioning rods 31 and 32 spaced away from each other and respectively arranged to match with the two perforations of paper documents punched by a paper puncher.

The bottom block 21 of the elastic clip 2 has a "I" shaped configuration with the rear portion made slightly narrower than the space between the two positioning rods 31 and 32 of the U-shaped frame bar 3 so as to allow the U-shaped frame bar 3 be set in a rest position with the two positioning rods 31 and 32 disposed by both lateral sides of the rear portion of the bottom block. Two piercing holes 22 are made on the rear portion of the bottom block 21 for fixation of the bottom lock 21 onto a file S. A bridge frame 23 is extended from the rear portion of the bottom block 21 to project upward and to bend forward by means of a folding line 2A. Which bridge frame 23 is having a tongue plate 24 at the front to provide a clamping effect against the bottom block 21 by means of the elastic force of the bridge frame 23. An arch frame 27 is set on the top of the bridge frame 23 with both ends integrally connected thereto by means of two rids 25 and 26 and with two folding lines **2*b* and 2*c* respectively arranged between the ribs 25 and 26 and the arch frame 27**.

When in application to clamp paper document P which has not been punched, the U-shaped frame bar 3 is set in a rest positon with both positoning rods 31 and 32 horizontally set by both lateral sides of the rear portion of the bottom block 21, and the tongue plate 24 is forced by the elastic force of the arch frame 27 to clamp the paper document P against the bottom block 21 (as shown in FIG. 2A). If the paper P is well punched, the U-shaped frame bar 3 is erected to let the two positioning rods 31 and 32 be respectively penetrating through the two punched holes P1 and P2 of the paper P. After the paper P is well positioned by means of the two positioning rods 31 and 32, the tongue plate 24 is pressed downward to clamp the paper P. By means of this arrangement, the tongue plate 24 may be conveniently lifted in a released position for setting thereon or for picking up therefrom of the paper P (as shown in FIG. 2B).

Figure 3A:
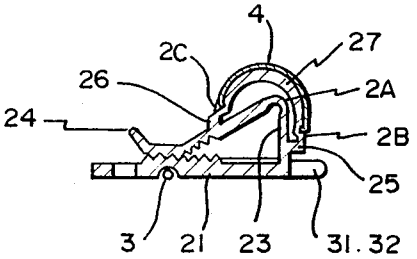
FIG. 3A is a sectional schematic drawing illustrating the mounting of the circular spring steel onto the arch frame (in a clamped position)
Figure 3B:
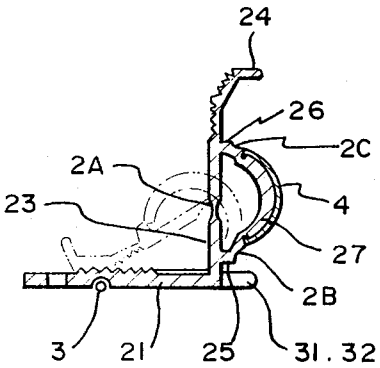
FIG. 3B is a sectional schematic drawing illustrating the mounting of the circular spring steel onto the arch frame (in a released position)

As shown in FIGS. 1, 3A and 3B, there is provided an U-shaped spring steel 4 to mount on the arch frame 27 so as to reinforce the clamping effect of the tongue plate 24. The arch frame 27 is having two elongated notches made at both front and rear ends for respective connection of the two hook-shaped ends 41 and 42 of the U-shaped spring steel 4 so as to allow the U-shaped spring steel 4 be firmly mounted thereon to further provide a reinforced elastic force to firmly keep the tongue plate 24 in a released position when it is turned upward or to firmly press the tongue plate 24 downward against the bottom block 21 when it is turned downward to a clamping position.

Figure 4:
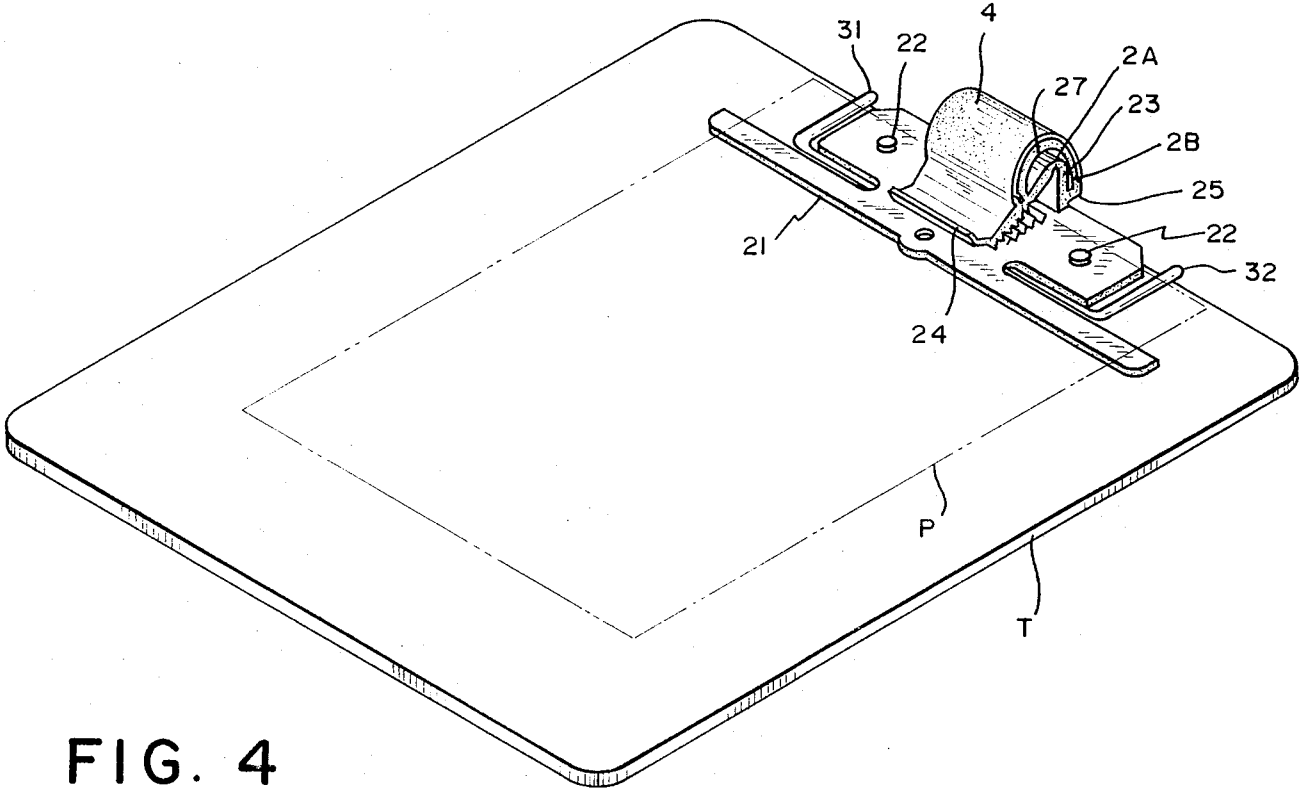
FIG. 4 is a schematic drawing of a second embodment made according to the present invention (in a released position).

Referring to a second embodiment of the present invention as shown in FIG. 4, the elastic clip is firmly connected to a rectangular plate arranged in a size properly for holding of hand, to let the tongue 24 provide a clamping effect for positioning of paper P. This embodiment is most suitable for use in restaurant for writing down the order or for use in any other situations for making notes. Although this structure is similar to regular clip file, it is more convenient to operate and provides better performance.

I claim:

1. An elastic clip with positioning means for positioning of perforations including a bottom block with an U-shaped frame bar movably mounted thereon, said U-shaped frame bar having two positioning rods, said bottom block having a "I" shaped configuration with the rear portion made slightly narrower than the space betwen said two positioning rods of said U-shaped frame bar so as to allow said U-shaped frame bar be set in a rest position with said two positioning rods disposed by both lateral sides of the rear portion of said bottom block; two piercing holes being made on the rear portion of said bottom block for fixation of said bottom lock onto a file by means of fastening means; a bridge frame being extended from the rear portion of said bottom block to project upward and to bend forward by means of a folding line, said bridge frame having a tongue plate at the front to provide a clamping effect against said bottom block by means of the elastic force of said bridge frame; an arch frame being set on the top of said bridge frame with both ends integrally connected thereto by means of two ribs and with two folding lines respectively arranged between said two ribs and said arch frame; and characterized in that said U-shaped frame bar may be set in a rest position with said two positioning rods horizontally set by both lateral sides of the rear portion of said bottom block, and said tongue plate being forced by the elastic force of said arch frame to clamp against said bottom block for retaining paper document; or said U-shaped frame bar may be erected to let said two positioning rods be respectively penetrating through the two punched holes of a paper that has been punched, and after punched paper is well positioned by means of said two positioning rods, said tongue plate being pressed downward to clamp the paper.

2. An elastic clip with positioning means for positioning of perforations as in claim 1, wherein an U-shaped spring steel is having two hook-shaped ends and provided to mount on said arch frame to reinforce the clamping effect of said tongue plate, said arch frame having two elongated notches made at both front and rear ends for respective connection of said two hook-shaped ends of said U-shaped spring steel so as to allow said U-shaped spring steel be firmly mounted thereon to further provide said tonque plate with a reinforced elastic force to clamp against said bottom block.

3. An elastic clip with positioning means for positioning of perforations as in claim 1, wherein the assembly of the elastic clip is firmly connected to a rectangular plate arranged in a size properly for holding of hand, to form a clip file and to let said tongue plate provide a clamping effect for clamping paper document.

* * * * *